US007025577B2

(12) United States Patent
Ioi et al.

(10) Patent No.: US 7,025,577 B2
(45) Date of Patent: Apr. 11, 2006

(54) ENCLOSED-CONFIGURATION ELECTRICALLY POWERED COMPRESSOR HAVING ELECTRIC MOTOR WITH STATOR COIL THEREOF COOLED BY FLOW OF REFRIGERANT PRIOR TO COMPRESSION OF THE REFRIGERANT

(75) Inventors: Nobuyasu Ioi, Motosu-gun (JP); Shinichi Ogawa, Oobu (JP)

(73) Assignee: Denso Corporation, Kariya (JP)

( * ) Notice: Subject to any disclaimer, the term of this patent is extended or adjusted under 35 U.S.C. 154(b) by 117 days.

(21) Appl. No.: 10/722,425

(22) Filed: Nov. 28, 2003

(65) Prior Publication Data

US 2004/0109771 A1 Jun. 10, 2004

(30) Foreign Application Priority Data

Nov. 29, 2002 (JP) ..... 2002-348411

(51) Int. Cl.
*F04B 17/03* (2006.01)
*H02K 9/00* (2006.01)

(52) U.S. Cl. ..... 417/371; 417/410.5; 310/54

(58) Field of Classification Search ..... 417/410.5, 417/371; 310/201, 51, 54
See application file for complete search history.

(56) References Cited

U.S. PATENT DOCUMENTS 5,873,710 A * 2/1999 Tucker ..... 417/410.5
5,998,903 A * 12/1999 Umeda et al. ..... 310/179
2001/0012489 A1* 8/2001 Harakawa et al. ..... 417/371
2001/0036414 A1* 11/2001 Makino et al. ..... 417/312

FOREIGN PATENT DOCUMENTS

JP B2 6-74787 9/1994

* cited by examiner

*Primary Examiner*—Charles G. Freay
(74) *Attorney, Agent, or Firm*—Oliff & Berridge, PLC

(57) ABSTRACT

An enclosed-configuration electrically powered compressor has an electric motor with a segment-type stator coil that is directly cooled by a flow of refrigerant from an intake aperture in the casing, directed onto one or both of the coil end portions of the stator coil. Each coil segment is formed of a U-shaped conductor having rectangular cross-section, with each coil end portion having regular spaces formed between the conductors such as to present low resistance to the flow of refrigerant, with the refrigerant also flowing through the rotor/stator air gap of the motor.

12 Claims, 6 Drawing Sheets

Related Art

Related Art

ENCLOSED-CONFIGURATION ELECTRICALLY POWERED COMPRESSOR HAVING ELECTRIC MOTOR WITH STATOR COIL THEREOF COOLED BY FLOW OF REFRIGERANT PRIOR TO COMPRESSION OF THE REFRIGERANT

BACKGROUND OF THE INVENTION

1. Field of the Invention

The present invention relates to improvements in an enclosed-configuration electrically powered compressor which compresses a gaseous working fluid such as a refrigerant, for use in such applications as air conditioners, and in particular vehicle air conditioners, or refrigerators etc.

2. Description of Prior Art

A prior art type of electrically powered compressor for use in cooling applications is described for example in Japanese patent 6-74787. This compressor is of cylindrical configuration, positioned with a vertical orientation, and having an internal space which encloses an electric motor and a compressor section arranged in series. The electric motor is disposed with the drive shaft oriented vertically, within a lower part of the casing, and drives the compressor section (which is a scroll-configuration compressor) that is located within an upper part of the casing. The drive shaft of the electric motor drives an eccentric shaft of the compressor section via a bearing, whereby a moveable scroll member is driven with respect to a fixed scroll member.

The respective locations of the electric motor and the compressor section within a lower part and an upper part of the casing, respectively, serve to ensure that damage does not occur as a result of a mixture of refrigerant and lubricating oil being drawn into the compressor section. Most of the lubricating oil remains in an oil pool in a lower part of the region which contains the electric motor. The lubricating oil is drawn up from the oil pool through lubricating oil through-holes formed in the axis of the rotor of the electric motor, to be thereby supplied to various parts of the apparatus.

The stator coil is a continuously-wound type of coil (i.e., as opposed to a segment type of coil, described hereinafter) formed on the stator core, as shown in the cross-sectional view of FIG. 1 of that patent disclosure.

A refrigerant intake aperture which opens into the internal space in the casing is located facing an intake aperture of the compressor section, so that most of the refrigerant which flows through the refrigerant intake aperture is directly drawn into the compressor section. As a result, that flow of refrigerant does not effect any substantial cooling of the stator coil, and in particular of the outer end portions of the stator coil.

Thus with such a type of prior art electrically powered compressor, little consideration is given to cooling of the electric motor. In order to prevent motor overheating, it is necessary to use an electric motor having a power rating which is sufficiently large to ensure that sufficient dissipation of heat will occur, rather than a motor whose power output capability is optimum with respect to the requirements for driving the compressor section. In addition, when such a continuously-wound type of stator coil is used, the occupancy factor of the stator slots (i.e., percentage of cross-sectional area of a slot that is occupied by conductors) is relatively low, by comparison for example with a segment-configuration coil. As result, it is difficult to make the stator of such an electric motor small in diameter. In addition, the conductors in the coil end portions of the stator coil may be sharply bent outward, and thus may readily be damaged, or the insulation thereon may be damaged. For these reasons, the coil end portions can only be made of limited length.

For the above reasons, with a prior art type of electrically powered compressor, it has been difficult to achieve both a high level of drive power combined with small size and light weight for the electric motor. Hence, it has not been possible to achieve an electrically powered compressor which has high efficiency and is also compact and light in weight.

SUMMARY OF THE INVENTION

It is an objective of the present invention to overcome the above problems, by providing an electrically powered compressor in which an electric motor produces an appropriate level of drive power, while enabling the overall electrically powered compressor to be made compact and light in weight and to operate with high efficiency.

More specifically, the invention provides an electrically powered compressor having a casing formed with at least one refrigerant intake aperture for intake of an externally supplied refrigerant into an internal space within the casing, and having a refrigerant outlet aperture for outputting the refrigerant to the exterior, an electric motor enclosed in the casing, and a compressor section which is also enclosed in the casing, directly driven by the motor for compressing the refrigerant which has entered from the refrigerant intake aperture and for impelling the refrigerant out through the refrigerant outlet aperture. According to a first aspect of the invention, the compressor is characterized in a first feature whereby the motor has a stator coil which is of segment configuration, i.e., formed of a plurality of coil segments each formed of an electrical conductor that is of substantially rectangular shape in cross-section, with respective coil segments being electrically connected in a predetermined manner, and a second feature whereby each refrigerant intake aperture is located such as to direct a flow of the refrigerant onto a corresponding one of a pair of axially opposed coil end portions of the stator coil.

The invention is applicable to use of both AC and DC types of electric motor. Furthermore the cross-sectional shape of the coil segments is not necessarily limited to being completely rectangular, and could be substantially I-shaped or U-shaped. Furthermore although embodiments of the invention will be described in which the compressor section is a scroll-type compressor, the invention is not limited to use of such a type of compressor section. Moreover it is not essential that the electric motor and compressor section be disposed successively along an axial direction of the casing, or that the compressor section be directly driven by the electric motor, as described for the embodiments hereinafter.

Moreover it is not essential that the electrically powered compressor be configured such that a flow of refrigerant from an intake aperture is blown directly onto a coil end portion of the stator coil, and it could be arranged that the refrigerant is blown indirectly onto the coil end portion, or onto both of the coil end portions.

More specifically, the stator coil is formed of a plurality of coil segments each having a U-shaped configuration formed of a curved portion which connects two parallel portions leading to open ends, so that one of the coil end portions of the stator coil is formed of the curved portions of respective segments, while the axially opposing coil end portion is formed of the open end portions of the segments. With the first aspect of the invention it is possible to dispose one or a pair of refrigerant intake apertures such that a flow of refrigerant is blown onto only the coil end portion that is formed of the curved portions of coil segments, or onto only the coil end portion that is formed of the open end portions of coil segments, or onto both of these coil end portions. Furthermore, when the electric motor and the compressor section are successively positioned along the axial direction of the casing, it is possible to dispose either one of these the coil end portions adjacent to the compressor section.

Although the invention is described for the case of cooling applications, in which a gaseous working fluid which is compressed by the compressor section is a refrigerant, the invention is not limited to use of a refrigerant, and is applicable in general to compression of a gaseous working fluid.

Furthermore it is possible to orient the electrically powered compressor in either a horizontal or vertical configuration, or at an oblique angle.

The following basic effects are achieved by the above two features of the first aspect of the invention. Firstly, due to the fact that the coil end portion (or each of the two coil end portions) onto which the refrigerant is blown is formed with regular spaces between adjacent conductors, the amount of flow resistance presented to the refrigerant is much lower than would be the case when a continuous-wound type of stator coil is used, in which there are only narrow, irregular spaces (if any) between the densely packed adjacent conductors. Due to the low degree of flow resistance, there is only a small amount of drop in pressure of the refrigerant due to flowing through a coil end portion. This enables improved performance to be achieved when the compressor is used in a cooling application such as an air conditioner, as measured by the COP (Coefficient of Performance), which is the ratio of cooling capacity to consumed power, e.g., with each of these measured in kW. In addition, the electrically powered compressor can be made more compact and light in weight.

A second effect obtained is a high value of occupancy factor for the slots in the stator core which accommodate those portions of the stator coil other than the coil end portions. That is to say, due to the use of a segment-configuration coil in which each conductor is of approximately rectangular cross-sectional form, substantially the entirety of each slot can be filled with successively stacked conductors, to a greater degree than is possible with using a conventional (i.e., wire having a round cross-sectional form) type of continuous conductor. The stator can thereby be made more compact and light in weight, or conversely, for the same scale of electric motor, the shaft power output can be increased.

A third effect obtained with the first aspect of the invention is that since the refrigerant is blown from an intake aperture onto at least one of the coil end portions of the stator coil, effective cooling of the stator coil is achieved for at least part of the conductors forming the stator coil. Enhanced conduction is thereby obtained, so that the generation of Joule heat is reduced. Since electrical losses caused by Joule heat are smaller, the efficiency of the electric motor is increased accordingly, so that the overall efficiency of the electrically powered compressor is enhanced, while in addition since the amount of heat that must be dissipated from the casing is decreased, the requisite size of the casing can be reduced. This further enables the overall compressor to be made more compact and light in weight.

According to a second aspect, a first one of the two coil end portions is located relatively far from the compressor section and a second one of the pair is located relatively close to the compressor section, and a single refrigerant intake aperture is provided which directs a flow of refrigerant onto the first one of the coil end portions. Here, the terms "close to" and "far from" respectively signify that the length of the flow path of the refrigerant (i.e., from a coil end portion to the intake aperture of the compressor section) is relatively short, or relatively long. In this case, after entering from the refrigerant intake aperture, and flowing through and thereby cooling the aforementioned first coil end portion, the refrigerant is then drawn along the air gap between the stator and rotor, axially through the interior of the electric motor. Hence, effective cooling of the electric motor by the refrigerant is achieved, so that for a given level of shaft output power, the motor can be made more compact and light in weight.

According to a third aspect of the invention, in addition to the above features, the electrically powered compressor has two additional features. Firstly, the refrigerant intake aperture is disposed immediately facing and adjacent to an outer periphery of the aforementioned first coil end portion of the stator coil, and secondly, the compressor intake aperture is located close to an outer periphery of the aforementioned second coil end portion. As a result, the refrigerant from the refrigerant intake aperture first flows from the outer periphery to the inner periphery of the first coil end portion, then flows axially along the air gap between the stator and rotor to reach the inner periphery of the second coil end portion, then flows from the inner periphery to the outer periphery of that second coil end portion, to be then finally drawn into the intake aperture of the compressor section.

In that way, the entirety of the electric motor is cooled in three stages by the refrigerant flow. In the first stage, the refrigerant flows from the outer periphery to the inner periphery of the first coil end portion. At that time at least a part of the refrigerant flows through the spaces between the conductors in that coil end portion, to thereby cool the first coil end portion, with there being little resistance to that refrigerant flow, due to the use of a segment type coil as mentioned hereinabove, so that little loss of pressure of the refrigerant occurs.

In the second stage, the refrigerant flows along the air gap between the stator and rotor, whereby heat is directly absorbed from the linear portions of the coil segments that are contained within the slots in the stator core. In particular, heat is absorbed from the lowest conductor or lowest layer of conductors, within each slot.

Furthermore, preferably one or more through-holes extending along the axial direction are formed in the stator core and/or in the rotor of the electric motor, so that cooling is further effected by a flow of refrigerant via these through-holes, in parallel with the flow which occurs through the air gap. In addition, the total cross-sectional area of flow path for the refrigerant is thereby increased, so that amount of pressure loss of the refrigerant in passing from the refrigerant intake aperture to the compressor section intake aperture is decreased.

Furthermore if the electric motor is a brushless DC motor having a plurality of permanent magnets mounted in axially extending slots in the periphery of the rotor, then the refrigerant will flow through these slots, further reducing the amount of pressure loss of the refrigerant. In addition, the permanent magnets will be effectively cooled, and so will maintain a high level of magnetizing force, thereby increasing the efficiency of the motor.

If the electric motor is of a type having a coil formed on the rotor, or has a cage-type rotor, the conductors of the rotor will be effectively cooled by the refrigerant, so that generation of Joule heat will be reduced, and the efficiency of the motor increased.

In the third stage, the refrigerant flows from the air gap to the inner periphery of the aforementioned second coil end portion of the stator coil, then flows from that inner periphery to the outer periphery of the second coil end portion, to thereby reach the intake aperture of the compressor section. When that occurs, a part of the refrigerant which passes out of the air gap will flow through the spaces between the conductors in the second coil end portion, thereby effectively cooling that coil end portion. Since the spaces between adjacent conductors in the second coil end portion are regularly arranged, in the same manner as for the first coil end portion, there is little loss of pressure of the refrigerant due to flowing through the second coil end portion.

In that way, the entirety of the electric motor is effectively cooled by the refrigerant which flows from the refrigerant intake aperture in the casing to the intake aperture of the compressor section, so that the efficiency of the electric motor is increased while minimizing the loss of pressure of the refrigerant that occurs (i.e., by comparison with the case in which the refrigerant flows directly from the intake aperture in the casing to the intake aperture of the compressor section).

According to a fourth aspect of the invention, in addition to the first aspect described above, two additional features are provided. Firstly, the coil segments of the stator core are each formed substantially in a U-shaped configuration, i.e., with a curved portion and a pair of open end portions, with respective coil segments being connected by welding at the tips of open end portions. Secondly, a plurality of insulating members each formed of an electrically insulating material such as synthetic resin are disposed covering the welded portions of the open end portions of the coil segments, while a part of each open end portion, extending from the vicinity of the tip to the vicinity of the stator core, is exposed to the interior space in the casing, other than being covered by a thin layer of electrically insulating material such as enamel insulation which covers all of each coil segment other than parts near the tips of the open end portions thereof.

This arrangement serves to prevent the possibility of short-circuits occurring between the welded parts of the coil segments and adjacent parts of the casing etc., while also ensuring effective heat dissipation from the parts of each conductor in the coil end portion that are not covered by the insulating members, i.e., since the insulating members can be arranged such as to maintain wide spaces between adjacent conductors in that coil end portion, to thereby allow free passage of the refrigerant flow from the outer periphery to the inner periphery. For maximum heat dissipation, the length of each portion of a coil segment (within the coil end portion containing the welded connections) that is not covered by an insulating member is made as long as possible.

According to a fifth aspect, in addition to the features of the first aspect described above, with each of the coil segments of the stator coil formed in a U-shaped configuration, the refrigerant intake aperture is disposed such as to blow the refrigerant onto the one of the two coil end portions that is formed of a plurality of the U-shaped portions of the coil segments. In that case, since it is not necessary to provide protection such as insulating members on these U-shaped portions, there is an unobstructed flow of the refrigerant through the spaces between the conductors in that coil end portion. Hence, there is a minimum amount of loss of pressure of the refrigerant due to flowing through that coil end portion, and effective heat dissipation is achieved.

According to a sixth aspect, in addition to the features of the first aspect described above, for at least one of the coil end portions of the stator core, a distance between that coil end portion and an electrically conductive member that is closest to the coil end portion and is external to the electric motor is made greater than, but no more than twice, an insulation distance that is specified in the Japan Industrial Standards. The overall length of the electrically powered compressor can thereby be minimized while eliminating the danger of short-circuits 5 or leakage currents occurring between a coil end portion and adjacent parts of the casing, etc.

According to a seventh aspect, in addition to the features of the first aspect described above, the refrigerant intake aperture is positioned such that the refrigerant from the intake aperture is blown toward a coil end portion (or, when two refrigerant intake apertures are provided, both of the coil end portions) in a direction such as to circulate around an outer periphery of that coil end portion. That is to say, instead of being blown directly towards a coil end portion from the intake aperture, the refrigerant is blown in a direction approximately tangential to the outer periphery of that coil end portion. In that way, a flow of refrigerant from the outer periphery to the inner periphery of that coil end portion occurs at positions around the entire outer periphery of that coil end portion, thereby ensuring that the entirety of that coil end portion is effectively cooled. The temperature distribution throughout that coil end portion can thereby be made substantially uniform, with localized overheating being prevented, thereby increasing the reliability and efficiency of the electric motor.

DESCRIPTION OF PREFERRED EMBODIMENTS

First Embodiment

Figure 1:
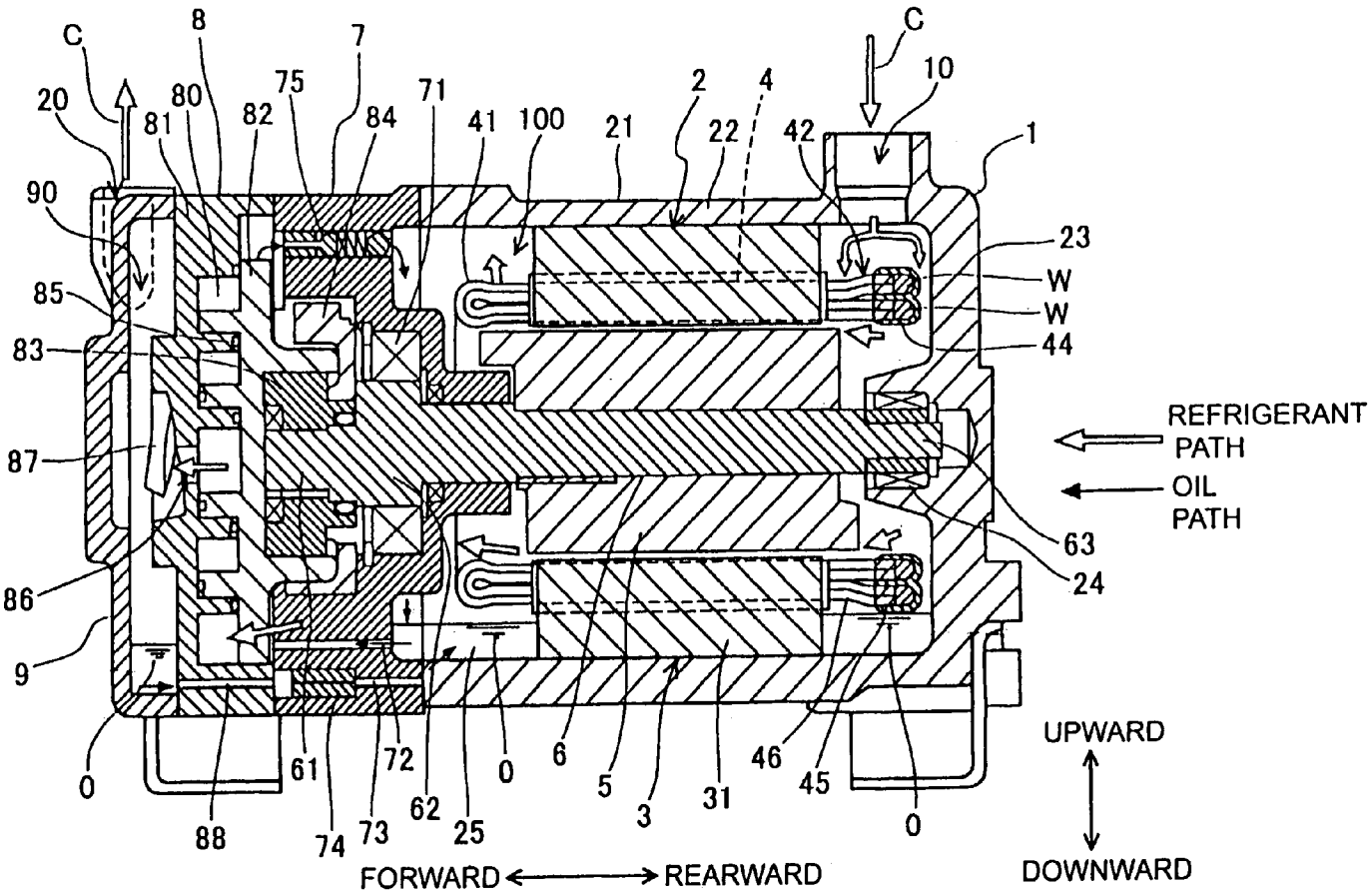
FIG. 1 is a cross-sectional view of a first embodiment of an electrically powered compressor, taken along the axial direction of a motor shaft.

FIG. 1 shows a first embodiment of an electrically powered compressor, suitable for use in a vehicle air conditioner. To avoid confusion in the following description and in the appended claims, the term "compressor section" will be used in referring to a mechanism (within an electrically powered compressor) which is driven by an electric motor to perform compression of a refrigerant. The overall configuration of this embodiment will first be described. The embodiment can be broadly divided into a casing 1, an electric motor 2, a bearing holder 7, a compressor section 8, and an outer casing 9. The casing 1 has a refrigerant intake aperture 10 and a refrigerant outlet aperture 20. The refrigerant intake aperture 10 connects to the exterior and receives a flow of a refrigerant C from an external cooling cycle. The term "cooling cycle" as used in this description signifies a system which receives a flow of compressed refrigerant and thereby performs a cooling function (i.e., by refrigerant expansion and heat-exchanging operations) as is well known. The refrigerant C is compressed by the compressor section 8 and impelled to the exterior from the refrigerant outlet aperture 20, to be used in the cooling cycle. The embodiment is a enclosed-configuration electrically powered compressor, with the casing 1 being of hollow cylindrical shape, having an internal space 100 formed therein. The casing 1 has the longitudinal axis thereof disposed horizontally, with the electric motor 2 contained at one end thereof and the compressor section 8 contained at the other end thereof. For ease of description, the end of the casing 1 at which the compressor section 8 is located will be referred to in the following as the forward end, and the end at which the electric motor 2 is located will be referred to as the rearward end. As opposed to the technology of the prior art, the casing 1 is not formed integrally as a single member, but is formed of a motor casing 21 which is in the shape of a cylinder that is closed at one end thereof, the outer periphery of the bearing holder 7, the outer periphery of the compressor section 8, and an outer casing 9, with these being successively joined along the axial direction of the electric motor 2 in a continuous manner. Hence, this embodiment can be made more compact and light in weight than a prior art type of electrically powered compressor, having separate casings for an electric motor and for a compressor unit.

The motor casing 21, which constitutes the rearward part of the casing 1, has the aforementioned refrigerant intake aperture 10 located for intake of the refrigerant C from a position vertically above the refrigerant intake aperture 10. The refrigerant intake aperture 10 is located in a portion 22 of the motor casing 21, close to the rearward end of the motor casing 21, adjacent to a rear portion 23 which closes off a cylindrical portion 22 of the motor casing 21 and forms the rearward end portion of the motor casing 21.

The refrigerant outlet aperture 20 is formed in the outer casing 9, communicating with the outlet chamber 90, and is located for ejecting the refrigerant C vertically upward after the refrigerant has been ejected by the compressor section 8 into the interior of the outlet chamber 90.

The electric motor 2 is disposed within the casing 1, and is a synchronous type of PM (permanent magnet) motor formed of a stator 3 having a stator core 31 which is fixed to the casing 1, a stator coil 4 formed on the stator core 31, and a rotor 5 which is electrically driven by the stator 3. Although not shown in the drawings, a plurality of permanent magnets are mounted around the periphery of the rotor 5, with the rotor 5 being of substantially cylindrical configuration.

The rearward outer-end portion 63 of the shaft 6, which is fixedly attached to and supports the rotor 5, is rotatably mounted in a rear bearing 24 which is fixed in the rear portion 23 of the motor casing 21. A large-diameter portion 62 of the shaft 6 is formed close to the forward end of the shaft 6, with that large-diameter portion 62 being rotatably mounted in a front bearing 71 which is held in a bearing holder 7. Thus the shaft 6 of the electric motor 2 is rotatably supported at the forward end portion 62 by the front bearing 71 and at the rearward end portion 63 by the rear bearing 24. The shaft 6 transmits motive power to the compressor section 8 from the electric motor 2. The forward end of the shaft 6 is integrally formed with an eccentric shaft 61 which functions as the drive shaft of the compressor section 8, and which has a predetermined amount of eccentricity with respect to the axis of rotation of the shaft 6 and has a central axis that is parallel to the axis of rotation of the shaft 6, as shown in FIG. 1.

The compressor section 8 is thereby driven by the electric motor 2 to compress the refrigerant C that is supplied from the refrigerant intake aperture 10 to the interior space 100, with the compressed refrigerant C being ejected from the refrigerant outlet aperture 20 as described above. With this embodiment, the compressor section 8 is a scroll type of compressor, having a fixed scroll member 81 and a movable scroll member 82, with a compression chamber 80 formed between the fixed scroll member 81 and movable scroll member 82. The intake aperture (not shown in the drawings) of the compressor section 8 is formed in the bearing holder 7, near the outer periphery of the movable scroll member 82, and so communicates with the interior space 100 of the motor casing 21.

The fixed scroll member 81 and movable scroll member 82 of the compressor section 8 have mutually opposing enmeshed scroll blades, which slide with respect to one another such that a compression chamber 80 is formed between the fixed scroll member 81 and movable scroll member 82. A convex portion of cylindrical shape is formed protruding from the rear part of the scroll blades of the movable scroll member 82, with that convex portion having a concave portion formed therein. A slide bush 83 is engaged in that concave portion, and the eccentric shaft 61 is rotatably supported in the slide bush 83. When the eccentric shaft 61 is rotated by the shaft 6, a counterbalancer 84 is also rotated via the slide bush 83, in synchronism with the motion of the movable scroll member 82 and the eccentric shaft 61, to thereby suppress the generation of vibration due to the eccentric position of the centers of gravity of the movable scroll member 82 etc.

Grooves are formed along the tip portions of the scroll blades of the fixed scroll member 81 and movable scroll member 82, and a tip seal 85 is engaged in these grooves, to thereby maintain an appropriate level of hermetic sealing between the fixed scroll member 81 and movable scroll member 82.

Oil flow paths are formed in the bearing holder 7 and in the compressor section 8, whereby as the movable scroll member 82 etc., rotate, appropriate amounts of lubricating oil O flow along these oil flow paths, from a lubricating oil reservoir 25 which is formed in a lowermost portion of the interior space 100. Specifically, oil flow paths 72, 73, a fixed shutter 74, and a pressure reduction valve 75 are provided in the bearing holder 7, while an oil flow path 88 is also formed in the fixed scroll member 81.

When this embodiment is used in an application such as a vehicle air conditioner, there may be times when the greater part of the interior space 100 of the motor casing 21 will be filled with a liquid that is a mixture of the refrigerant C in the liquid phase and the lubricating oil O. In order to ensure that the compressor section 8 will not be damaged as a result of intake of large amounts of such a liquid mixture, the compressor section 8 is designed with a sufficient degree of tolerance.

The refrigerant C which is drawn into the compressor section 8 and is then compressed into the compression chamber 80, then moves from a peripheral region to be collected at a central region of the compressor section 8, to be then ejected into the outlet chamber 90, in the interior of the outer casing 9, through the outlet port 86 and the outlet valve 87. The outlet valve 87 functions as a reverse flow blocking valve. The refrigerant C is then supplied from the refrigerant outlet aperture 20 through external piping (not shown in the drawings) to the aforementioned cooling cycle, with the pressure of the refrigerant C substantially unchanged from that in the outlet chamber 90.

Features of the First Embodiment

The embodiment of an electrically powered compressor described above is basically characterized by two features, i.e., the stator coil 4 of the electric motor 2, and the position and orientation of the refrigerant intake aperture 10, as follows.

Figure 2:
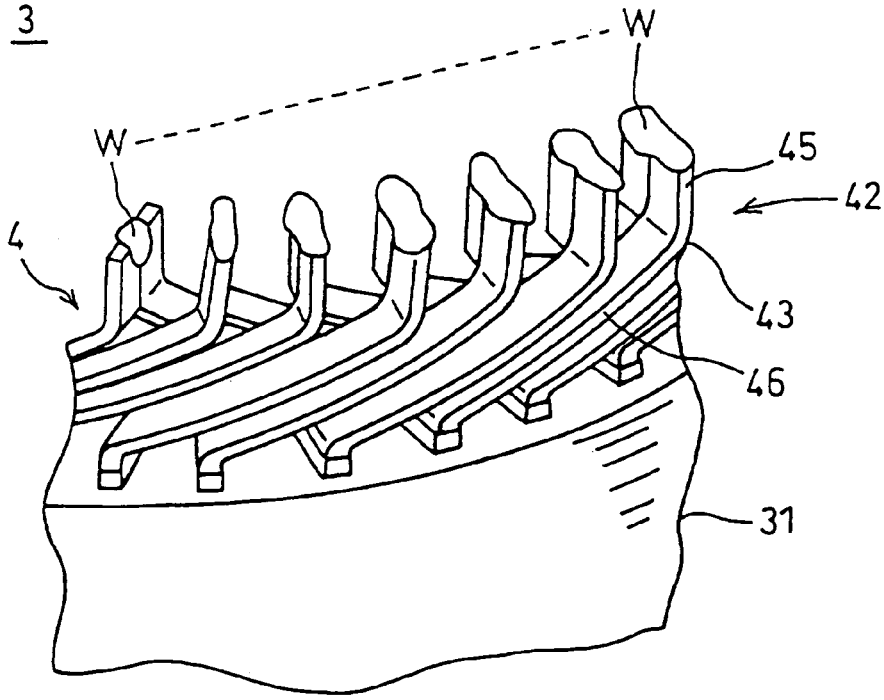
FIG. 2 is a partial oblique view of a rearward coil end portion of a stator coil of the first embodiment.

Firstly, the characterizing feature of the stator coil 4 lies in the use of a segment-configuration coil. That is to say, the stator coil 4 is formed of a plurality of successively connected electrically conductive coil segments, each being of formed from copper rod which has an approximately rectangular cross-sectional shape. FIG. 2 is a partial oblique view which illustrates the configuration of the rearward coil end portion 42 of the stator coil 4, its relationship to the stator core 31, and the manner of interconnecting the coil segments. As shown, open end portions 43 of the coil segments protrude from the stator core 31, with the tip portions of respective pairs of these coil segment open ends 43 being welded together to provide an electrical connection. There will be a certain degree of manufacturing variations in the shapes and sizes of the resultant welded portions, designated by W in FIG. 2, however it is ensured that these are within an allowable range of variation. Each of the coil segments constituting the stator coil 4 is covered overall with an electrically insulating layer of enamel material, including the open end portions 43, other than a part of each open end portion 43 that extends a short distance from the tip portion thereof (i.e., to permit welding of the tip to be performed).

Such a part of each open end portion that extends from the welded tip portion for a predetermined short distance from that tip portion will be referred to as an insulation-protected portion 45. These are the only parts of each coil segment constituting the stator coil 4 that is not covered by the insulating layer of enamel material. Instead, as illustrated in FIG. 1, each of these insulation-protected portions 45 is covered by one of a plurality of electrically insulating members 44. The electrically insulating members 44 are mounted to cover each welded portions W and the adjacent insulation-protected portions 45 after the welding has been performed. Thus as can be understood from FIG. 2, in the rearward coil end portion 42, each coil segment has an exposed portion 46 (i.e., which is only covered by a thin layer of enamel material) which extends from the stator core 31 to the start of a corresponding insulation-protected portion 45.

Each insulating member 44 is made as thin as possible, in order to dissipate as much heat as possible to the refrigerant C through each insulation-protected portion 45.

As can be readily understood from FIG. 2, the rearward coil end portion 41 is formed by bending each of respective open end portions of coil segments that extend axially outward from the stator core 31, and then performing the aforementioned welding connection of appropriate pairs of these bent end portions. In addition, the stator coil 4 has a forward coil end portion 41 as shown in FIG. 1, which is formed of curved portions of respective coil segments of the stator coil 4, protruding outward from the stator 3 along the axial direction. Respective linear portions (not shown in the drawings) of the coil segments of the stator coil 4 are contained within axially extending slots which are formed in the periphery of the stator core 31.

With this embodiment, a set of four linear portions of respective coil segments are successively stacked (i.e., along the radial direction, with respect to the motor shaft axis) within each of the slots in the stator core 31. Due to the fact that the cross-sectional shape of each coil segment is approximately rectangular, and each linear portion is covered with a layer of enamel material that is extremely thin, it can be ensured that almost 100% of the cross-sectional area of each of the slots in the stator core 31 is filled with the linear portions of coil segments.

The spacing between each of the coil end portions 41, 42 and the most closely adjacent electrically-conductive member that is external to the electric motor is made greater than (but no more than twice) the distance that is specified in the JIS (Japan Industrial Standards). For example, the closest distance between the forward coil end portion 41 and the bearing holder 7 is made approximately 1.5 times the distance that is specified in the JIS. Hence in spite of the fact that there will be variations in size and shape between different coil segments of the stator coil 4, the appropriate minimum separation distance as specified in the JIS will be maintained. Similarly, the closest spacing between metal parts of the rearward coil end portion 42 and the rearward portion of the motor casing 21 is approximately 1.5 times the distance that is specified in the JIS.

The second feature consists of the position and orientation of the refrigerant intake aperture 10, from which the refrigerant C is directed onto the rearward coil end portion 42 of the stator coil 4, and the position (i.e., near the periphery of the interior space 100 of the motor casing 21) of the intake aperture through which the refrigerant C is drawn into the compressor section 8. Specifically, the refrigerant intake aperture 10 is located facing the outer periphery of the rearward coil end portion 42, i.e., the coil end portions 41, 42 that is located farther from the compressor section 8, so that the refrigerant C, after entering the interior space 100, first flows radially inward (i.e., towards the axis of rotation of the electric motor), then flows axially, then radially outward. It can be understood that this results from the fact that the refrigerant intake aperture 10 is disposed facing the outer periphery of the one of the pair of coil end portions 41, 42 that is located relatively distant from the compressor section 8.

The intake aperture of the compressor section 8, as described above, is located adjacent to the outer periphery of the forward coil end portion 41 (i.e., the one of the pair of coil end portions 41, 42 that is relatively close to the compressor section 8), with that intake aperture passing through the bearing holder 7 as described above. As a result, the refrigerant C is drawn into the compressor section 8 at a position which is close to the periphery of the interior space 100, i.e., a position that is close to the forward coil end portion 41.

Effects Obtained with the First Embodiment

The first embodiment has the following basic features. Firstly, since the stator coil 4 is formed as a segment-configuration coil, each of the coil end portions 41, 42 can be formed with regularly arranged spaces between the coil segments. This ensures a minimum amount of loss of pressure of the refrigerant C due to passing through the rearward coil end portion 42. This regular spacing between the coil segments in the rearward coil end portion 42 is shown in FIG. 2. Although not shown in the drawings, the curved (bent) portions of coil segments which constitute the forward coil end portion 41 as described hereinabove are also disposed with regularly arranged spaces between the coil segments.

Hence, by comparison with a type of stator coil which is formed with the conductors having narrow, irregular spaces between them in the coil end portions, the configuration of the above embodiment ensures that the forward coil end portion 41 and rearward coil end portion 42 present a low resistance to the flow of the refrigerant C through them. As a result, when the electrically powered compressor is used in an air conditioner apparatus, an enhanced value of COP (Coefficient of Performance, which is a measure of the efficiency of a cooling apparatus which utilizes a refrigerant) is achieved by comparison with the prior art, which is especially significant when the compressor is operating at a high speed of rotation. The overall efficiency of a vehicle air conditioner which incorporates the embodiment can thereby be increased, and the air conditioner can be made more compact and light in weight.

It is especially important that an electrically powered compressor for use in a vehicle air conditioner, such as the above embodiment, should result in an excellent "cool down" characteristic for the air conditioner. This is measured with the compressor operating close to its maximum speed of rotation. Hence, since this embodiment enables the COP to be improved within a range of speeds of rotation close to the maximum, its use can directly improve the performance of a vehicle air conditioner in which it is incorporated.

By comparison with a prior art type of electrically powered compressor that would provide a similar cool-down characteristic, the above embodiment enables power consumption to be reduced and so enables running costs to be reduced. Alternatively stated, for the same level of performance, the above embodiment can be made more compact and light in weight than has been possible in the prior art, so that the cost of materials for manufacturing the compressor can be reduced, and the amount of work involved in the manufacturing process is reduced, so that the cost of the final manufactured product can be lowered.

A second basic feature of the above embodiment results from the fact that the stator coil 4 is formed as a segment-configuration coil. Since the stator coil 4 is formed of a plurality of segments as described above, the percentage of the cross-sectional area of the slots in the stator core 31 that is occupied by the conductors of the stator coil 4 can be increased, by comparison with a continuous-winding type of stator coil (i.e., formed of a continuous length of wire). Hence, the electrical losses in the stator coil 4 are lowered by comparison with a continuous-winding type of stator coil, and the amount of heat dissipated by the stator coil 4 (for the same amount of drive power) is accordingly reduced, so that the stator 3 can be made smaller in size and more light in weight.

Specifically, the respective diameters of the stator core 31 and the motor casing 21 can each be reduced, and the axial length of each of the stator 3 and motor casing 21 can be made shorter. Moreover, by comparison with the prior art, for the same amount of shaft output power from the electric motor 2, the lengths of each of the forward coil end portion 41 and rearward coil end portion 42 of the stator coil 4 along the axial direction can each be made shorter, and this further contributes to enabling the stator 3 to be made compact and light in weight.

It can thus be understood that due to the use of a segment-configuration coil as the stator coil 4, the efficiency of the electric motor 2 can be increased, so that the electric motor 2 can produce an increased level of output power, or can be made more compact and light in weight.

A third basic feature obtained with the above embodiment results from the fact that the refrigerant intake aperture 10 is disposed such as to open into the interior space 100 at a location which faces the outer periphery of the rearward coil end portion 42 of the stator coil 4, i.e., such that the refrigerant C is blown directly onto the rearward coil end portion 42. This can be understood from FIG. 1, which illustrates how the refrigerant C enters through the refrigerant intake aperture 10, to be blown directly onto the rearward coil end portion 42 and thereby effecting cooling of the rearward coil end portion 42. Furthermore as described hereinafter, the refrigerant C then cools substantially the entirety of the stator coil 4, before being drawn into the compressor section 8. As a result, each of the coil segments of the stator coil 4 has the entire length of that coil segment made lower in temperature, so that the electrical resistance of each coil segment is lowered, and generation of heat by the Joule effect is thereby reduced.

Due to the reduced generation of Joule heat, the efficiency of the electric motor 2 is increased accordingly, so that the overall efficiency of the electrically powered compressor is increased. The heat generated by the stator coil 4 is in part absorbed by the flow of refrigerant C and in part is dissipated to the exterior from the casing 1. However with the above embodiment, due to the reduced amount of Joule heat which is generated in the stator coil 4, the size of surface area of the casing 1 (and hence, the volume of the casing 1) that is required to dissipate heat generated by the stator coil 4 can be reduced accordingly. Hence, the compressor can be made more small in scale, and lighter in weight.

It can thus be understood that with the above embodiment, two basic points of importance are that the stator coil 4 of the electric motor 2 is formed of coil segments, and that the refrigerant C is blown onto the rearward coil end portion 42. Due to that combination of features, the effects and advantages described above can be obtained. As a result, for the same power rating as a prior art type of enclosed-configuration electrically powered compressor, the above embodiment provides improved efficiency (e.g., as measured by the COP of a vehicle air conditioner which incorporates the embodiment) and can be made compact and light in weight. The improvement in the COP of a vehicle air conditioner that utilizes such a compressor reflects the fact that the embodiment has high efficiency when operating with a high speed of rotation, resulting in an improved cool-down performance of the air conditioner. This ensures that the manufacturing cost of a vehicle air conditioner which incorporates such an electrically powered compressor can be lowered, and that the vehicle air conditioner can operate with reduced power consumption, so that the running costs are reduced. Moreover, the overall cost of a vehicle in which such an electrically powered compressor is installed can also be reduced and enhanced performance achieved.

The third basic feature will be described in more detail in the following. With the third basic feature, the refrigerant intake aperture 10 is located adjacent to the outer periphery of the rearward coil end portion 42 of the stator coil 4, which is the coil end portion that is farthest from the compressor section 8, while the intake aperture of the compressor section 8 is located near the outer periphery of the forward coil end portion 41, i.e., the coil end portion that is closest to the compressor section 8. The third effect results from these two factors.

Specifically, the refrigerant C which is taken in through the refrigerant intake aperture 10 first flows from the outer periphery to the inner periphery of the rearward coil end portion 42, then flows along an axial direction through the air gap that is formed between the stator 3 and the rotor 5, to reach the inner periphery of the forward coil end portion 41. The refrigerant C then flows from that inner periphery to the outer periphery of the forward coil end portion 41, and is then drawn into the intake aperture (not shown in the drawings) of the compressor section 8. In that way, the refrigerant C effects overall cooling of the electric motor 2 in three stages, as follows.

In the first stage, the refrigerant C that is supplied through the refrigerant intake aperture 10 flows from the outer periphery to the inner periphery of the rearward coil end portion 42. When this occurs, a part of the flow of refrigerant C passes through the gap between the insulation-protected portions 45 of the rearward coil end portion 42 and the rear portion 23 of the motor casing 21, to thereby reach the inner periphery of the rearward coil end portion 42. However the size of that gap is limited to a value that is greater than (but no more than twice) the insulation distance that is specified in the JIS, and so is very narrow. As a result, most of the flow of refrigerant by-passes that gap, and instead passes through the spaces between the aforementioned exposed portions 46 of the rearward coil end portion 42 (with only a small amount of flow resistance occurring, as described above)O although a part of the flow of refrigerant C passes over the insulation-protected portions 45 of that coil end portion 42, and so by-passes the exposed portions 46 and the spaces between these. This occurs most strongly at the part of the rearward coil end portion 42 on which the refrigerant C is directly blown. However this flow of the refrigerant C over the insulation-protected portions 45 occurs along both peripheral directions around the rearward coil end portion 42 (i.e., as viewed perpendicular to the axis of the electric motor 2, both the clockwise and counterclockwise directions) and so covers the entire outer periphery of the rearward coil end portion 42.

In the second stage, the refrigerant C passes through the air gap formed between the stator 3 and the rotor 5, along the forward axial direction. When this occurs, heat is extracted by the refrigerant C from the linear portions of the innermost layers of the coil segments of the stator coil 4 that are held within slots (not shown in the drawings) in the stator core 31 as described above, and also from the inner periphery of the stator core 31. Hence, due to the heat that is transferred from the coil segments of the stator coil 4 and the stator core 31, the refrigerant C indirectly cools the innermost layer of the four layers of linear portions of coil segments in the slots of the stator core 31.

Although not shown in the drawings, the stator 3 and the rotor 5 of the electric motor 2 have through-holes formed therein, extending along the axial direction. Since a part of the flow of the refrigerant C passes through these holes, cooling of the stator 3 and the stator coil 4 is enhanced, and the effective flow path of the refrigerant C is widened, so that the rate of flow is made more slow than would otherwise be the case. As a result, the amount of pressure loss of the refrigerant C is reduced. The rotor 5 has permanent magnets (not shown in the drawings) which are cooled by the flow of refrigerant C, so that excessive heating of these permanent magnets is thereby prevented. The magnetic force of the permanent magnets can thereby be maintained at a high level, so that the efficiency of the electric motor 2 is further enhanced.

In the third stage, the refrigerant C flows from the air gap, etc., to the inner periphery of the forward coil end portion 41 of the stator coil 4 at a position close to the compressor section 8. The refrigerant C then flows from the inner periphery to the outer periphery of the forward coil end portion 41, to then reach the intake aperture (not shown in the drawings) of the compressor section 8. When this occurs, the greater part of the refrigerant C passes through the gaps that are formed between the curved portions of coil segments that constitute the forward coil end portion 41. Thus the forward coil end portion 41 is effectively cooled by the refrigerant C. Due to the fact that the gaps between the curved portions of coil segments are formed with regular spaces, as described hereinabove, the loss of pressure of the flow of refrigerant C due to passing through the forward coil end portion 41 is comparatively small. A part of the flow of refrigerant C passes through the gap which exists between the forward coil end portion 41 and the bearing holder 7. However the size of that gap is limited to a value that is greater than (but no more than twice) the aforementioned insulation distance specified in the JIS. As a result, the amount of refrigerant C which flows through that gap is not substantial.

In that way, the refrigerant C that is drawn in through the refrigerant intake aperture 10 to the interior space 100 of the casing 1 cools the entirety of the electric motor 2 in three stages, and in particular, effectively cools the stator coil 4. As a result, the conductors of the stator coil 4 are lowered in temperature, so that the electrical conductance of the stator coil 4 is increased, and losses due to Joule heating are reduced. The efficiency of the electric motor 2 is thereby enhanced. Moreover due to the use of a segment-configuration coil as the stator coil 4, with regular spaces being formed between the conductors constituting the coil end portions 41 and 42, effective cooling can be applied to these portions (in which, otherwise, overheating can readily occur). In addition, as a result of the regular spacing between the conductors of the coil end portions 41 and 42, there is a reduced amount of pressure loss of the refrigerant C caused by flow through these coil end portions, i.e., there is reduced resistance to flow of the refrigerant C.

Due to the above combination of factors, a cooling apparatus such as a vehicle air conditioner which incorporates an electrically powered compressor in accordance with the above embodiment can have increased efficiency, e.g., as measured by the aforementioned COP.

Thus, for the same amount of shaft power being produced, the scale of the electric motor 2 can be reduced by comparison with the prior art, so that the entire electrically powered compressor can be made more compact and light in weight. It should be noted that this increase in efficiency of the electric motor 2 is obtained without the need to use any special manufacturing method or to use expensive materials in the manufacture of the motor, so that the cost of materials can be held low, and furthermore it is not necessary to use large-scale equipment to form and machine the component parts of the motor. Thus, the above embodiment can be produced at low manufacturing cost.

As a fourth basic feature of the first embodiment, dissipation of heat from the rearward coil end portion 42 to the refrigerant C is performed effectively. This is due to the fact that each of the insulating members 44, which are formed of a synthetic resin material, are made as thin as possible, and due to the fact that the area of the insulation-protected portion 45 which is covered by each insulating member 44 is made as small as possible. That is to say, those parts of the coil segments at which a short-circuit is most likely to occur (i.e., tip portions which are not covered by an enamel layer) are electrically insulated by a thin protectively layer of synthetic resin material constituted by the insulating members 44. On the other hand those parts of the rearward coil end portion 42 in which a short-circuit is unlikely to occur (i.e., the exposed portions 46) do not have such a covering, and so are spaced mutually farther apart at regular intervals. Thus these produce only a small amount of resistance to the flow of the refrigerant C, when it passes between them, and in addition they have a higher efficiency of heat dissipation.

As a result, the necessary degree of electrical insulation can be provided on those parts of the rearward coil end portion 42 that are connected by welding, while ensuring that effective cooling of the rearward coil end portion 42 is achieved by the flow of refrigerant C, and also ensuring that the amount of reduction of pressure of the refrigerant C resulting from passing through the rearward coil end portion 42 is minimized. As described above, to ensure that these effects are achieved as fully as possible, the exposed portions 46 are made as long as possible while, conversely, the insulation-protected portions 45 are limited to only those portions of the conductor ends that must be left uncovered, in order to enable welding to be performed.

A fifth basic feature is that the separation between each of the coil end portions 41 and 42 and adjacent electrically conductive members 7 and 23 respectively are set to be greater than (but no more than twice) the distance that is specified in the JIS. It is thereby ensured that no significant levels of leakage current will flow from the coil end portions 41 and 42, while also ensuring that the overall length of the electrically powered compressor is minimized. Moreover as described above, the greater part of the refrigerant C flows through the respective interiors of the coil end portions 41 and 42, with the remainder of the refrigerant C flowing through the gaps between the coil end portions 41 and 42 and the electrically conductive members 7 and 23 respectively, i.e., as a by-pass flow. Hence, the electric motor 2 can readily be designed such as to establish an appropriate balance between the requirements for:

(a) ensuring effective cooling of each of the coil end portions 41 and 42, and (b) minimizing the amount of pressure loss in the refrigerant C that results from resistance in the overall flow path between the refrigerant intake aperture 10 and the intake aperture of the compressor section 8.

It can be understood from the above that with the first embodiment, short-circuits and current leakage from the coil end portions 41 and 42 can be avoided while enabling the overall length of the electrically powered compressor to be minimized.

The following five effects are obtained with the above embodiment.

Firstly, due to the fact that resistance in the flow path of the refrigerant C is low, the amount of loss of pressure of the refrigerant C, between the point of entering the interior space 100 from the refrigerant intake aperture 10 and the point of entering the intake aperture of the compressor section 8, is low. This is especially true when operating at a high speed of rotation. Thus, the 5 efficiency of the electrically powered compressor is high, so that as described above the COP of an apparatus such as a vehicle air conditioner which utilizes such an electrically powered compressor can be high.

Secondly, due to the increased efficiency of the electric motor 2, the electrically powered compressor can be driven at a high level of power. Alternatively stated, for the same value of power rating, an electrically powered compressor in accordance with the above embodiment can be made more compact and light in weight than has been possible in the prior art, due to the increased efficiency of operation.

Thirdly, the embodiment can be made compact and light in weight, so that there is an according reduction in the amount of material used in its manufacture and in the extent of machining that must be performed in the manufacturing process, with no special materials or difficult shaping being required, and hence the manufacturing costs can be low.

Fourthly, since there is a lower degree of resistance to the refrigerant C in its flow path, the amount of pressure loss of the refrigerant C is small. As a result, the cool-down characteristic of a cooling apparatus such as an air conditioner which incorporates such an electrically powered compressor is excellent, and furthermore due to the high efficiency of the electric motor 2, the operating costs are lowered.

Fifthly, when an electrically powered compressor according to the above embodiment is installed in a vehicle, the greater degree of compactness of the compressor ensures that more space becomes available in the vehicle. Furthermore since the compressor is light in weight, the members which support the compressor can be made accordingly light in weight, so that the overall weight of the vehicle can be reduced. As a result, a vehicle incorporating such an electrically powered compressor can be made more compact and light in weight overall, with improved acceleration and driving characteristics and lowered fuel consumption being obtained for the vehicle. Hence, the overall performance of the vehicle will be enhanced, while in addition the manufacturing costs and running costs for the vehicle can be reduced.

Results of Comparison Tests

In order to validate the effects described above, the applicant has performed comparison tests in which an electrically powered compressor in accordance with the above embodiment and an electrically powered compressor (referred to in the following as the "comparison example") which differs from that embodiment only in having a prior art type of stator coil (i.e., of continuously-wound type) instead of a segment-configuration stator coil, but with both of the electrically powered compressors otherwise being of identical configuration. Both were operated under the same operating conditions to obtain the test results.

Figure 3:
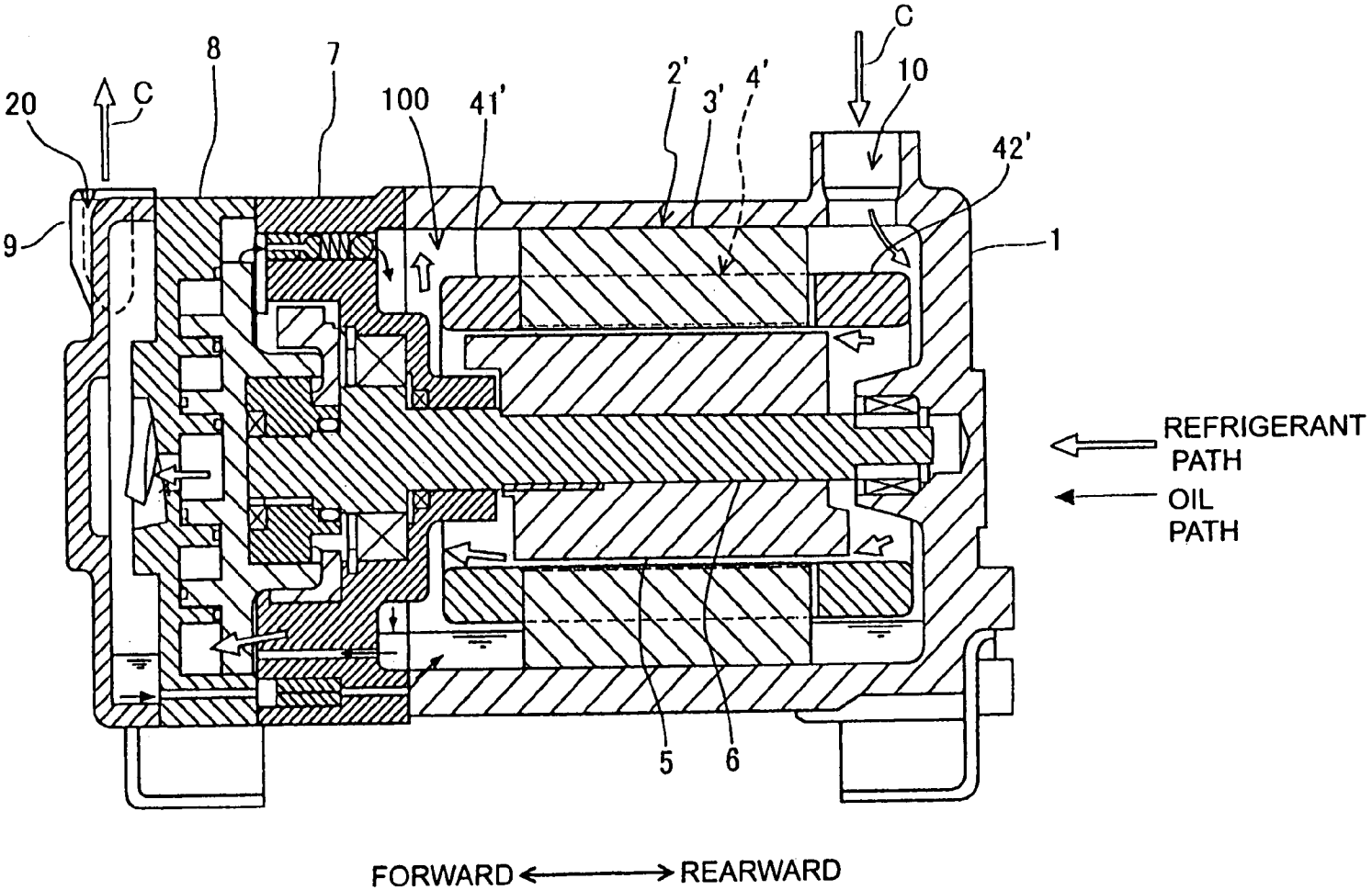
FIG. 3 is a cross-sectional view of an electrically powered compressor having a prior art configuration of stator coil, used as a comparison example in comparison testing.

FIG. 3 is a cross-sectional view taken along the axial direction, of the comparison example, in which the stator coil is designated by 4', having respective coil end portions 41' and 42', with the stator designated as 3'.

Figure 4:
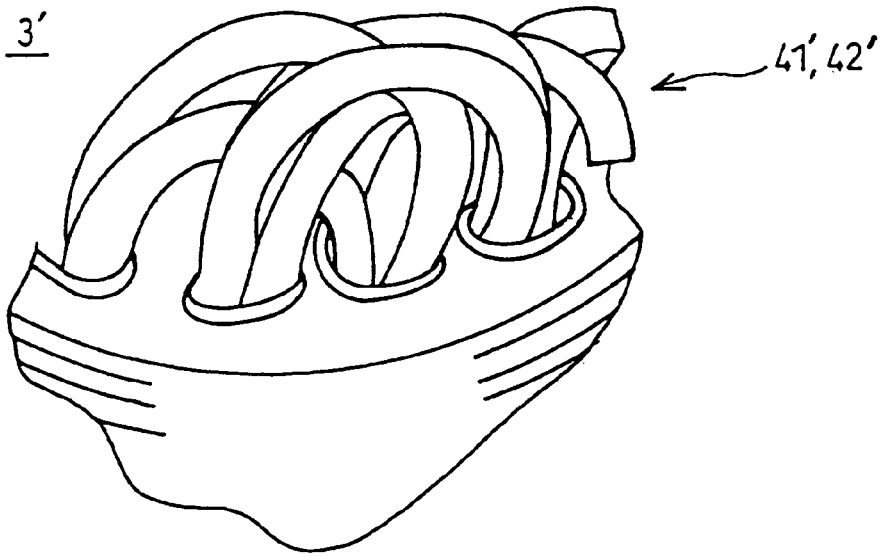
FIG. 4 is a partial oblique view showing the configuration of each coil end portion of a stator coil of the comparison example.

As shown, the stator coil of the comparison example has opposed end portions thereof in which the conductors are comparatively densely packed together, as illustrated in FIG. 4, without regularly formed spaces being provided between the conductors. Thus when the refrigerant C is blown onto the rearward coil end portion 42' from the refrigerant intake aperture 10, as shown in the upper right-hand region of FIG. 3, the flow of refrigerant C cannot freely pass through the coil end portion 42', or subsequently through the forward coil end portion 41', and so the refrigerant C flows mainly through the gaps between the exterior of the coil end portions 41', 42' and the adjacent parts of the casing 1 and the bearing holder 7 rather than passing through these coil end portions 41', 42'.

Thus, in addition to the fact that the conductors of the stator coil 4' have a thick coating of electrical insulating material, and so have a low volume occupancy factor in the stator 3' and poor heat dissipation characteristics, cooling of the stator coil 4' is further worsened by the fact that the refrigerant C does not blow through the coil end portions 41', 42'. As a result, electrical losses in the stator coil 4' due to Joule heating are increased by comparison with the above embodiment, and so a lowered level of performance of the electric motor 2' of the comparison example can be envisaged.

Moreover due to the fact that with the comparison example, the flow path for the refrigerant C is narrow, a substantial loss of pressure of the refrigerant C occurs as it flows from the refrigerant intake aperture 10 to the intake aperture of the compressor section 8. Hence, it can be expected that the aforementioned COP of a cooling apparatus such as an air conditioner which incorporates the comparison example would be lower than that which is obtainable by using the above embodiment in a cooling apparatus.

The comparison tests were performed with both the first embodiment described above and the comparison example having the following specifications:

Cylinder capacity of compressor section 8: 20 cc/rev.

Maximum power output of electric motor 2: 3 kW (at 8600 rpm)

Rated power output of electric motor 2: 2.25 kW (at 6700 rpm)

Refrigerant C : R134A (HFC refrigerant)

Lubricating oil O: POE (polyolethylene) refrigerant oil

Cooling capacity of cooling cycle: designed for maximum value of 6 kW, rated value of 4.5 kW External dimensions of electrically powered compressor: 110 mm (diameter)×200 mm (length), having substantially cylindrical shape The tests were performed on the respective compressors with the compressor connected to a cooling cycle having the same configuration and operating under the same conditions. Measurement of the performance was done by calculation on results obtained by using the same type of calorimeter. The operating conditions used for the comparison tests of each compressor were as follows:

Intake pressure: 0.196 MPa (2.0 kgf/cm$^2$)

Outlet pressure: 1.47 MPa (15 kgf/cm$^2$)

Superheater: 10° C.

Subcooling temperature: 5° C.

Ambient temperature: 25° C.

Oil rate: 2%±0.5% (ratio by weight)

The oil rate is the proportion of refrigerant machine oil that circulates within the refrigerant, in the cooling cycle.

Figure 5:
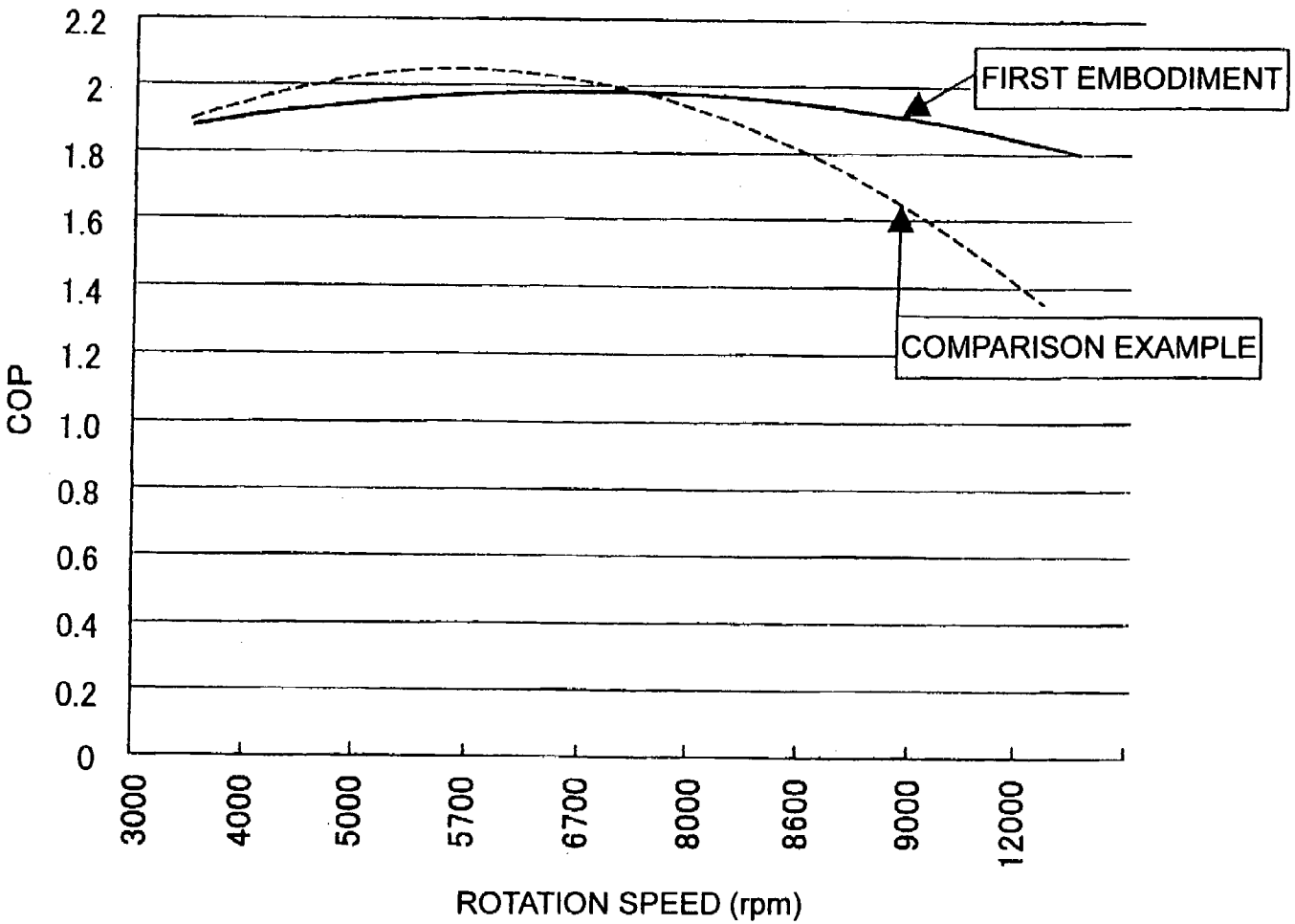
FIG. 5 shows graphs of results obtained from comparison testing of the first embodiment and of the comparison example.

FIG. 5 shows graphs of values of COP (plotted along the vertical axis) obtained from the results of the comparison tests performed under the above conditions on the comparison example and on an electrically powered compressor in accordance with the first embodiment described above, respectively, with speed of rotation of the electric motor 2 as a parameter.

As can be seen from FIG. 5, when operating at a speed of rotation which is near 6700 rpm, there is almost no difference between the respective values of COP obtained for the two machines. However when operating close to the maximum speed of approximately 8600 rpm, the COP values obtained for the above embodiment are clearly superior to that of the comparison example. As mentioned above, the performance of a vehicle air conditioner is not evaluated only based on the rated speed of rotation and rated level of power output, and the cool-down performance (when the air conditioner is operating at maximum power, with the compressor running close to its maximum speed of rotation) is equally important. This is the reason why the COP values obtained for the above embodiment are superior to those obtained for the comparison example.

It will further be apparent that the degree of superiority of performance of the above embodiment over the comparison example, as measured by the COP, would become even greater if the speed of rotation were to be further increased above the maximum value that was attained in the comparison tests. That is based on the fact that the amount of energy loss in the cooling cycle that results from a loss of energy due to loss of pressure of the refrigerant C will increase as the square of the flow speed of the refrigerant C. As described above, the coil end portions 41, 42 of the above embodiment are configured such as to ensure a wide flow path for the refrigerant C, ensuring a minimal loss of pressure of the refrigerant C as it flows from the refrigerant intake aperture 10 to the inlet aperture of the compressor section 8. Hence, the higher the speed of rotation, the greater will become the difference between the performance of the above embodiment (e.g., as measured by the COP) and that of a prior art type of electrically powered compressor such as the comparison example. This will be reflected in a correspondingly superior cool-down characteristic for an air conditioner which utilizes an electrically powered compressor in accordance with the above embodiment.

Furthermore, there is an increasing trend for electrically powered compressors which are used in air conditioners to be made more small and light in weight. Hence, such compressors are being operated at increasingly high speeds of rotation. As described above, the above embodiment provides improved performance when operated at a high speed of rotation, and so it can be expected that in future the advantages provided by the embodiment will become increasingly important, for enabling the efficiency of air conditioners to be improved.

As shown in FIG. 5, within a specific range of speeds of rotation, which are lower than the rated speed, the comparison example provides a slightly higher value of COP than the above embodiment. However when the compressor is operated in such a range, the power consumption of the electric motor 2 is comparatively low, so that the amount of heat that is absorbed in the cooling cycle is quite small, and hence a slight lowering of efficiency within that range of operation is not significant.

First Alternative Configuration of First Embodiment

As a first alternative configuration of the above embodiment, it would be possible to invert the positions of the coil end portions 41, 42, i.e., with the coil end portion 41 located at the rearward position and the coil end portion 42 located at the forward position, close to the compressor section 8, and with the location of the refrigerant intake aperture 10 left unchanged. In that case, the refrigerant intake aperture 10 would be positioned opposite the coil end portion 41, formed of the outwardly-protruding curved (U-shaped) portions of the coil segments of the stator coil 4. Such an alternative configuration can be readily envisaged from FIG. 1. In that case, the refrigerant C would blow directly onto the curved segment portions in the coil end portion 41, and since there are no welded portions therein, and the spaces between the conductors are large, the refrigerant C can readily flow between these conductors. Thus, a smaller loss of pressure will result from the flow of the refrigerant C through the coil end portion 41 than occurs with the first embodiment, when the refrigerant C is blown directly onto the coil end portion 42. In addition, the heat dissipation characteristics of the coil end portion 41 are better than those of the coil end portion 42. As a result of the smaller amount of pressure loss in the refrigerant C, an improvement can be expected in the COP that is attained when an electrically powered compressor having such a configuration is utilized in an air conditioner.

Second Alternative Configuration of First Embodiment

Figure 6:
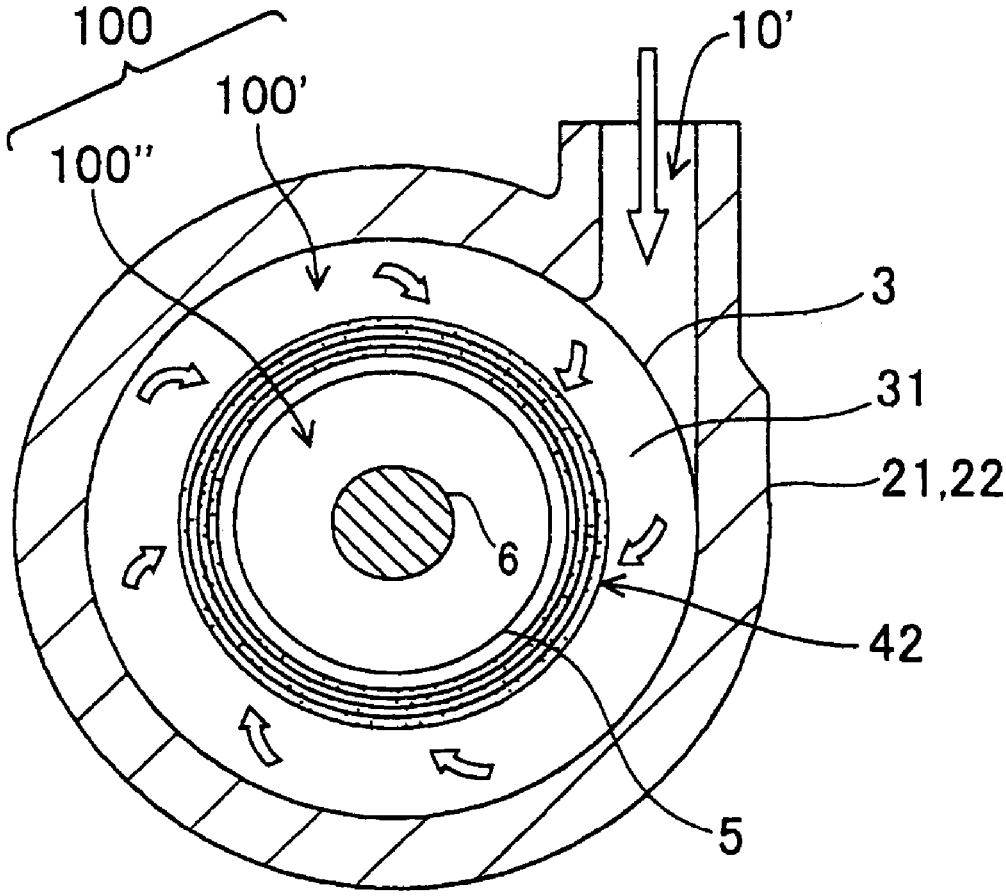
FIG. 6 is a cross-sectional view of a second alternative configuration of the first embodiment, taken perpendicular to the axial direction of the motor shaft.

A second alternative configuration of the first embodiment will be described referring to FIG. 6, which is a cross-sectional view taken perpendicular to the axial direction of the drive shaft of the electric motor 2. As shown, this differs from the first embodiment in that the location of the intake aperture of the refrigerant C is altered, with that aperture being designated as 10'. Specifically, the intake aperture 10' is disposed such as to direct the refrigerant C into an annular outer peripheral region 100' of the interior space 100 (i.e., moving approximately tangentially with respect to the outer periphery of the coil end portion 42), so that the refrigerant C circulates around the outer periphery of the coil end portion 42 before moving towards the inner periphery of that coil end portion.

Thus, in contrast to the first embodiment, the refrigerant C is not blown directly towards the rearward coil end portion 42 from the refrigerant intake aperture 10'. Instead, the refrigerant C circulates around the annular space 100', then passes through the rearward coil end portion 42 to enter an inner annular region 100" of the interior space 100, and thereby reach the air gap between stator and rotor and flow along that air gap towards the inner periphery of the forward coil end portion 41, as described for the first embodiment.

Thus, the operation of this configuration differs from that of the first embodiment in that the entirety of the rearward coil end portion 42 is substantially cooled, so that an even distribution of temperature is achieved around that coil end portion. Hence, the loss of pressure of the refrigerant C that results from flowing through the rearward coil end portion 42 is reduced, so that the performance (as measured by the COP) of an air conditioner which incorporates such an electrically powered compressor will be increased.

In particular, with the first embodiment it is possible that a part of the rearward coil end portion 42, other than the part onto which the refrigerant C is directly blown, will become overheated. However that possibility is eliminated, with the second alternative configuration. Thus, the reliability of the electric motor 2 can be enhanced. Furthermore due to the fact that the entirety of the rearward coil end portion 42 is substantially uniformly cooled, Joule heating losses are reduced, so that the efficiency of the electric motor 2 will be increased.

Thus with the second alternative configuration, in addition to the advantages provided by the first embodiment, overheating of parts of the rearward coil end portion 42 is prevented, so that both the reliability and efficiency of the electric motor 2 can be increased. Moreover with the second alternative configuration as described above, since the amount of loss of pressure of the refrigerant C (i.e., as it travels from the refrigerant intake aperture 10 to the inlet aperture of the compressor section 8) is lower than for the first embodiment, the COP of an air conditioner which is equipped with a compressor having the second alternative configuration will be increased, by comparison with using the first embodiment.

Third Alternative Configuration of First Embodiment

Figure 7:
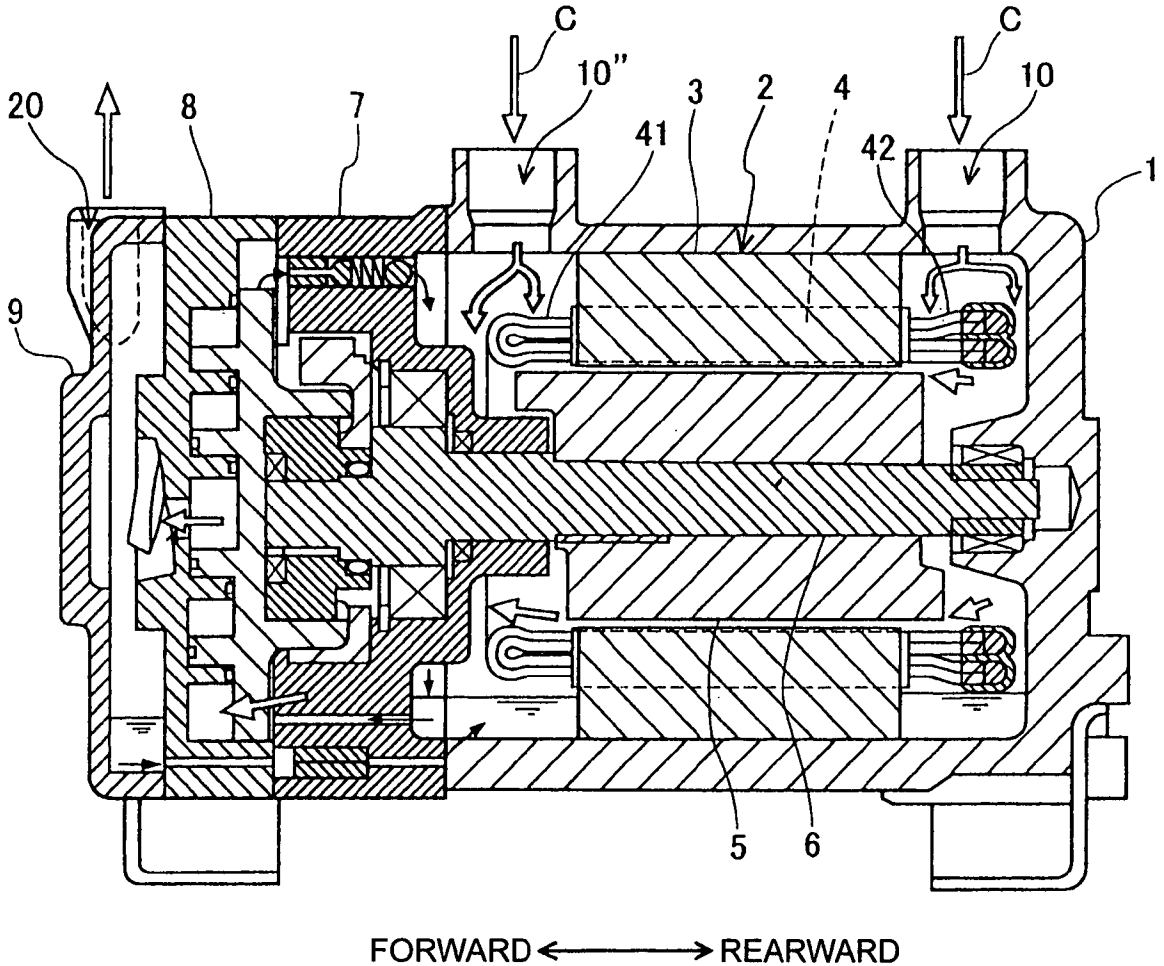
FIG. 7 is a cross-sectional view of a third alternative configuration of the first embodiment, taken along the axial direction of the motor shaft.

A third alternative configuration of the first embodiment will be described referring to FIG. 7, which is a cross-sectional view taken along the axial direction of the drive shaft of the electric motor 2. With the third alternative configuration, in addition to the refrigerant intake aperture 10 of the first embodiment, a second intake aperture for the refrigerant C is provided (designated as 10") located such as to blow the refrigerant C directly onto the forward coil end portion 41. With this configuration, since the refrigerant C is directly blown onto both of the coil end portions 41 and 42, effective cooling of both of these is achieved. Hence, overheating of the forward coil end portion 41 can be prevented, and in addition, it is unnecessary to make any special provisions for combining various flow paths of the refrigerant C into a single flow path, so that the number of component parts required can be reduced, and the manufacturing cost accordingly lowered.

Fourth Alternative Configuration of First Embodiment

With a fourth alternative configuration of the first embodiment, the intake aperture (not shown in the drawings) of the compressor section 8 is located adjacent to the forward coil end portion 41, facing the inner periphery of the forward coil end portion 41. With such a configuration, it becomes unnecessary for substantially the entire flow of refrigerant C to pass through the forward coil end portion 41 before reaching the intake aperture of the compressor section 8 (as occurs with the first embodiment) so that the amount of resistance in the flow path of the refrigerant C is reduced, and the loss of pressure of the refrigerant C is accordingly reduced. Hence, the COP of an air conditioner which is equipped with a compressor having the fourth alternative configuration will be higher than can be achieved by using the first embodiment.

However as described above for the first embodiment, the refrigerant C passes through the air gap between the rotor 5 and stator 3, before reaching the inner periphery of the forward coil end portion 42. At least a part of this flow of refrigerant C thereby acquires a circular component of flow velocity (i.e., rotating around the central axis of the electric motor 2), and with the fourth embodiment, this causes the refrigerant C to be blown onto 5 the forward coil end portion 41 before entering the intake aperture of the compressor section 8. The forward coil end portion 41 is thereby cooled to an appropriate extent. Hence with this configuration, overheating is effectively prevented for both the rearward coil end portion 42 and also for the forward coil end portion 41.

Fifth Alternative Configuration of First Embodiment

A fifth alternative configuration of the first embodiment will be described, referring again to FIG. 7, described above. In this case, the refrigerant C intake aperture 10 at the rearward location is omitted, with only the intake aperture 10" at the forward location being incorporated. With such a configuration, the refrigerant C passes directly to the intake aperture of the compressor section 8, or reaches that intake aperture after having passed through the forward coil end portion 41, without passing through the air gap between the rotor 5 and stator 3. Hence, the amount of resistance in the flow path of the refrigerant C is reduced, and the loss of pressure of the refrigerant C as it passes from the intake aperture 10" to the intake aperture of the compressor section 8 is accordingly reduced. The COP of an air conditioner which is equipped with a compressor having the fifth alternative configuration will thus be higher than can be achieved by using the first embodiment.

With such a configuration, in order to improve the heat dissipation characteristics of the rearward coil end portion 42, cooling fins are preferably formed on an appropriate portion of a surface of the motor casing 21. Alternatively, the electrically powered compressor could be mounted in a vertical orientation. If that is done, then electric motor can be designed such that the rearward coil end portion 42 is suitably cooled by being immersed in a pool of the lubricating oil O.

It should be noted that it would also be possible to envisage other alternative configurations than those described above, for an electrically powered compressor according to the present invention, which would fall within the scope claimed for the invention as set out in the appended claims.

What is claimed is:

1. An electrically powered compressor of enclosed configuration, comprising:

a casing enclosing an internal space, with at least one refrigerant intake aperture formed in said casing for intake of an externally supplied refrigerant into said internal space, and a refrigerant outlet aperture for outputting said refrigerant to the exterior of said casing;

an electric motor disposed within said casing, having a stator formed of a stator core that is fixedly attached to said casing, a stator coil formed on the stator core, a rotor which is mounted for rotation with respect to said stator, and a drive shaft which is fixedly attached to said rotor; and a compressor section disposed within said casing, driven by said electric motor for compressing said refrigerant which has entered said internal space from said refrigerant intake aperture and for impelling said refrigerant through said refrigerant outlet aperture in a compressed condition, wherein said stator coil is a segment-configuration coil formed of a plurality of coil segments each formed of an electrical conductor that is of substantially rectangular shape in cross-section, with said coil segments being mutually electrically connected in a predetermined arrangement, and said refrigerant intake aperture(s) is located such as to blow said refrigerant through at least one of a pair of axially opposed coil end portions of said stator coil.

2. The electrically powered compressor as claimed in claim 1, wherein a first one of said pair of coil end portions is located relatively far from said compressor section and a second one of said pair is located relatively close to said compressor section, and wherein said refrigerant intake aperture is a single aperture which is located such as to blow said refrigerant through said first one of said coil end portions.

3. The electrically powered compressor as claimed in claim 2, wherein said compressor section comprises a compressor intake aperture communicating with said internal space and wherein said refrigerant intake aperture is disposed immediately facing an outer periphery of said first coil end portion, and wherein said compressor intake aperture is located close to an outer periphery of said second coil end portion.

4. The electrically powered compressor as claimed in claim 2, wherein said compressor section comprises a compressor intake aperture communicating with said internal space and wherein at least one of said stator core and said rotor is formed with a plurality of axially extending through-holes, for enabling passage of a part of a flow of said refrigerant from said first coil end portion towards said compressor intake aperture.

5. The electrically powered compressor as claimed in claim 1, comprising a plurality of insulator members, wherein each of said coil segments is formed to be substantially U-shaped, with a curved portion connecting two parallel linear portions which extend to respective open end portions, with all of each of said coil segments other than regions adjacent to respective tip portions of said open end portions thereof being covered by a thin layer of electrically insulating material, respective ones of said coil segments are mutually connected at said tip portions of said open end portions by welding, a part of each of said open end portions extending from a welded tip portion thereof is covered by one of said insulator members, and a part of each of said open end portions, extending between one of said insulator members and said stator core, is exposed to said internal space of said casing, through said thin layer of electrically insulating material.

6. The electrically powered compressor as claimed in claim 1, wherein each of said coil segments is formed to be substantially U-shaped, with a curved portion connecting two parallel linear portions, and said refrigerant intake aperture is located such as to blow said refrigerant through a one of said pair of coil end portions that is formed of a plurality of said curved portions of said coil segments.

7. The electrically powered compressor as claimed in claim 1, wherein said refrigerant intake aperture is positioned such that said refrigerant from said intake aperture is blown towards said at least one coil end portion in a direction such as to circulate around an outer periphery thereof.

8. The electrically powered compressor according to claim 1, wherein said compressor section has a movable member which is directly coupled to a drive shaft of said electric motor, to be driven thereby.

9. The electrically powered compressor as claimed in claim 1, wherein said compressor section comprises a scroll-configuration compressor having a movable scroll member with a drive shaft which is directly connected to said drive shaft of said electric motor, for being eccentrically rotated thereby.

10. The electrically powered compressor as claimed in claim 1, wherein said casing is positioned with said drive shaft of said electric motor oriented horizontally.

11. The electrically powered compressor as claimed in claim 10, wherein said compressor section and said electric motor are disposed in series within said casing, with axes of respective drive shafts thereof oriented horizontally.

12. The electrically powered compressor as claimed in claim 1, wherein each of said coil segments is formed to be substantially U-shaped, with a curved portion connecting two parallel linear portions, said stator core is formed with a plurality of axially extending slots in an outer periphery thereof, and a plurality of said linear portions of said coil segments are successively stacked within each of said slots in said stator core.

* * * * *